United States Patent [19]

Steves

[11] Patent Number: 4,884,687

[45] Date of Patent: Dec. 5, 1989

[54] DOOR UNIT INSTALLATION KIT WITH PACKAGING AND DISPLAY CONTAINER

[75] Inventor: Marshall T. Steves, San Antonio, Tex.

[73] Assignee: Steves & Sons, Inc., San Antonio, Tex.

[21] Appl. No.: 47,623

[22] Filed: May 7, 1987

[51] Int. Cl.[4] ..... B65D 85/64

[52] U.S. Cl. ..... 206/321; 206/325; 206/453

[58] Field of Search ..... 206/325, 321, 443, 449, 206/453

[56] References Cited

U.S. PATENT DOCUMENTS

| | | | |
|---|---|---|---|
| 1,675,147 | 7/1926 | Walter | 206/321 X |
| 2,271,632 | 2/1942 | Diehl | 93/93 |
| 2,489,029 | 11/1949 | Guerrant | 206/325 |
| 2,742,146 | 4/1956 | Lester, Jr. | 206/325 |
| 2,757,854 | 8/1956 | Wall | 229/53 |
| 2,822,920 | 2/1958 | Lieber | 206/325 |
| 2,887,219 | 5/1959 | Lester, Jr. | 206/325 |
| 2,929,495 | 3/1960 | Simonsen | 206/325 |
| 3,949,932 | 4/1976 | Shore | 206/321 X |
| 4,116,334 | 9/1978 | Herzog | 206/453 |
| 4,127,188 | 11/1978 | Heaney | 206/453 |
| 4,429,751 | 2/1984 | Ruppel et al. | 206/453 X |
| 4,607,750 | 8/1986 | Valenti | 206/443 |

FOREIGN PATENT DOCUMENTS

| | | | |
|---|---|---|---|
| 1523403 | 8/1978 | United Kingdom | 206/453 |

*Primary Examiner*—Stephen Marcus
*Attorney, Agent, or Firm*—Gunn, Lee & Miller

[57] ABSTRACT

A method for assembling a door unit installation kit, together with a container that allows the kit to be conveniently packaged and displayed. The kit includes a door, jambs and other parts, designed to permit installation of a left- or right-handed or in or out opening door. The container is characterized by at least a cardboard top and a cardboard bottom piece that hold these door unit parts together. The cardboard pieces are foldable into place around the door unit and have cut out portions at appropriate locations to hold the door unit parts securely in place. The kit is assembled by folding and fastening the container pieces, and inserting the door unit parts therein.

6 Claims, 4 Drawing Sheets

DOOR UNIT INSTALLATION KIT WITH PACKAGING AND DISPLAY CONTAINER

I. BACKGROUND

This invention relates to the field of packaging, shipping and product display. More particularly, it relates to a door unit installation kit such as may be used for homes and offices. These door units contain a number of parts necessary for on-site installation, such as the door, a hinge jamb, a strike jamb, a head jamb, a sill, a sweep, molding and insulation strips. The invention consists of a special container that allows the kit to be conveniently packaged, displayed and transported.

Flat rigid articles, such as doors, wallboard, panelling and the like are typically packaged and shipped in bundles containing a number of such articles. Various means have been developed to package such bundles. One type of packaging consists of tying means such as disclosed un U.S. Pat. No. 2,271,632. The doors may then be sold as single units to the end user, often in an unpackaged form.

A few packaging methods are directed to packaging of single articles, such as a door. For example, U.S. Pat. No. 2,757,854 discloses a tube into which a door may be inserted.

Still other packaging methods are directed to packaging fragile items such as glass sheets and products such as doors that contain glass sheets. Such packaging has traditionally used rigid hard containers of material such as wood. U.S. Pat. No. 4,127,188 discloses another type of packaging container for a single unit designed to prevent breakage and permit easy handling and stacking.

Doors are often sold as separate units as in the methods of packaging discussed above, but may also be sold as part of a door installation unit. These units include various materials used to build the door, such as jambs, sills and sweeps. Hardware may also be included.

Door units sold in an assembled or partially assembled form are referred to in the trade as "pre-hung". These doors are sold with the jamb already attached around the door with hinges. When sold in this form, the jamb itself frames and protects the door, and there is not a problem of loose pieces.

When door units are sold unassembled, there is a problem of securing the various parts. Commonly used forms of packaging simply bundle the various pieces with wire or cord. One such bundling method is a metal band tightly strung around the door. A problem with this type of method is that the metal band is damaging to the surface of the material being packaged unless some form of cushion or pad is placed between the band and the door. Additionally, the metal band is often difficult to cut. A further problem is that the door unit parts are not well-secured inside the packaging and may easily slide out from the band.

Another form of packaging consists of a shallow receptacle into which the ends of the longest pieces are placed. Parts such as the jambs or sills are not stationary and move around inside the packaging, resulting in an unwieldy and hard to carry package.

II. OBJECTS OF THE INVENTION

Because of the numerous parts of a complete door installation kit, a need exists for securely packaging them as a unit. Ideally, the door unit should be packaged as a firm bundle, without rattling or sliding of the door unit parts against each other. Accordingly, one object of the invention is to provide a means of packaging door units that will allow all parts to be securely packaged together. The invention provides a means for each unit to be packaged in a manner such that the various part will not rattle and knock against each other.

Additionally, the aesthetic features of the door itself call for a means of packaging that will allow the door to be viewed by prospective purchasers. Thus, another object of the invention is to provide a means of packaging door units that will permit an attractive display of the door.

It is also desirable to have a packaging means that will allow the door unit to be stored and transported without damage to the door. Thus, another object of the invention is to provide a means of packaging door units that will protect the door from damage during storing and transport of the door unit.

Other desired features of door unit packaging are that it be lightweight, inexpensive, and easy to unpackage. Another object of the invention is to satisfy these features.

III. BRIEF DESCRIPTION OF THE DRAWINGS

Figure 2:
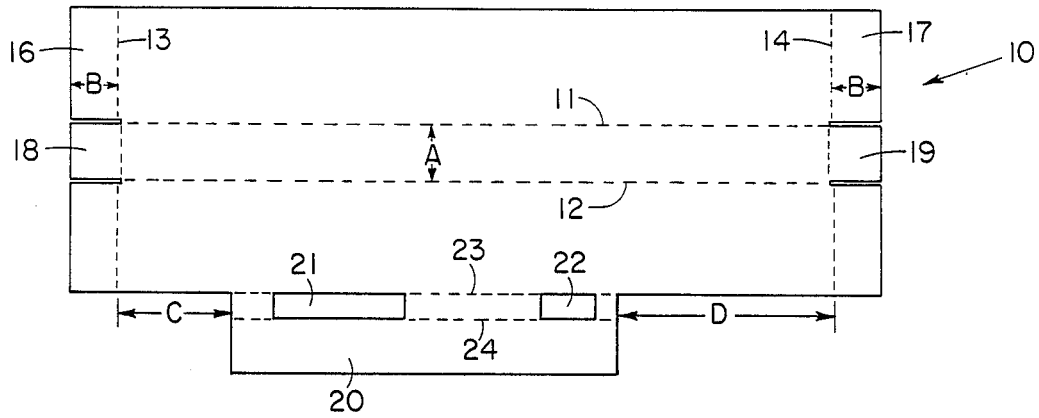
FIG. 2 is a plan view of the bottom piece of the invention.
Figure 2A:
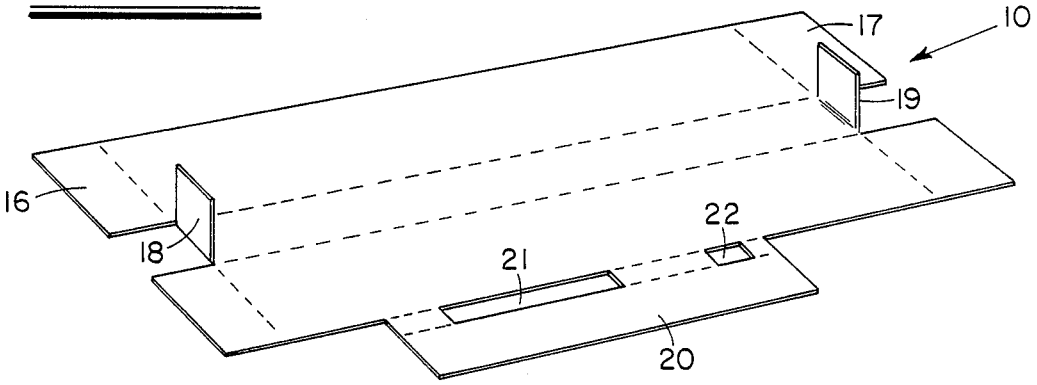
Figure 2B:
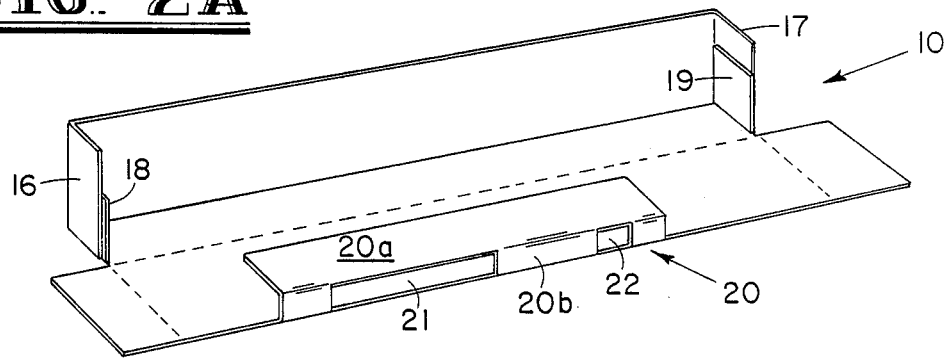
Figure 2C:
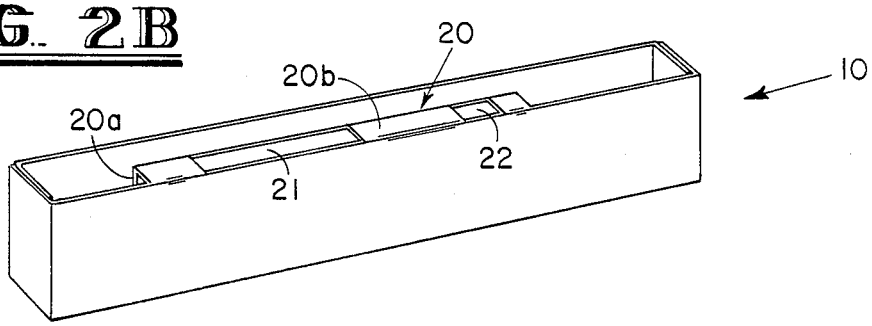

FIGS. 2A, 2B, and 2C are a series of perspective views, showing the bottom piece as folded for packaging a door unit.

Figure 3:
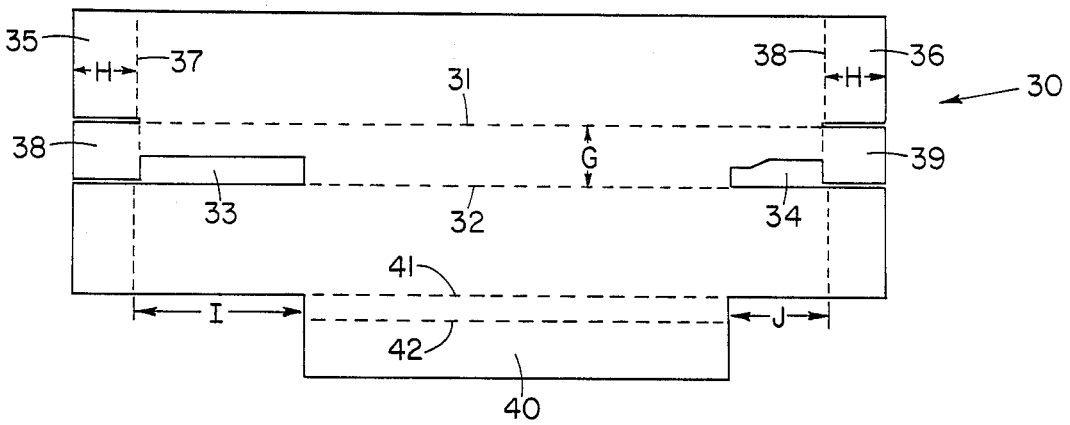

FIG. 3 is a plan view of the top piece of the invention.

Figure 3A:
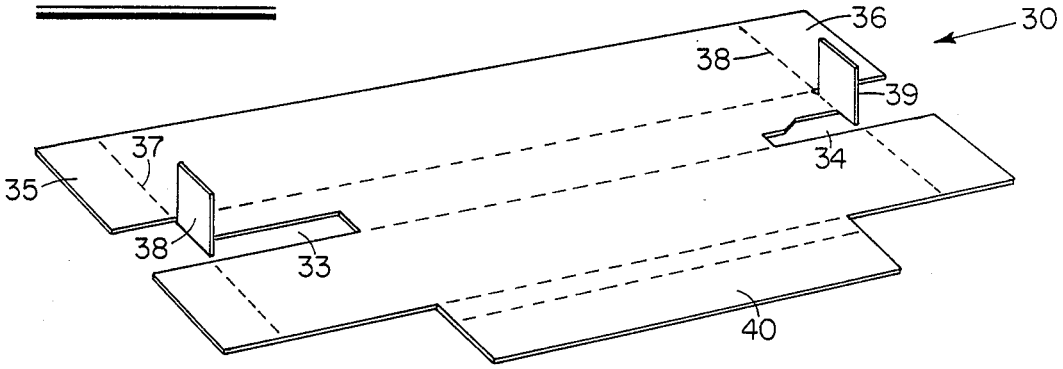
Figure 3B:
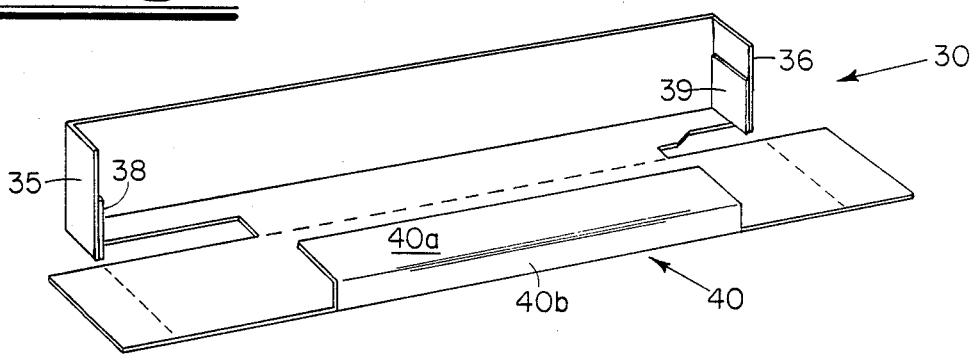
Figure 3C:
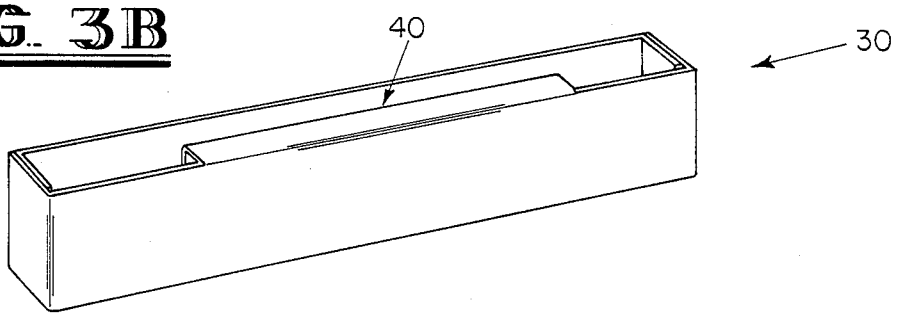

FIGS. 3A, 3B, and 3C are a series of perspective views, showing the top piece as folded for packaging a door unit.

Figure 4:
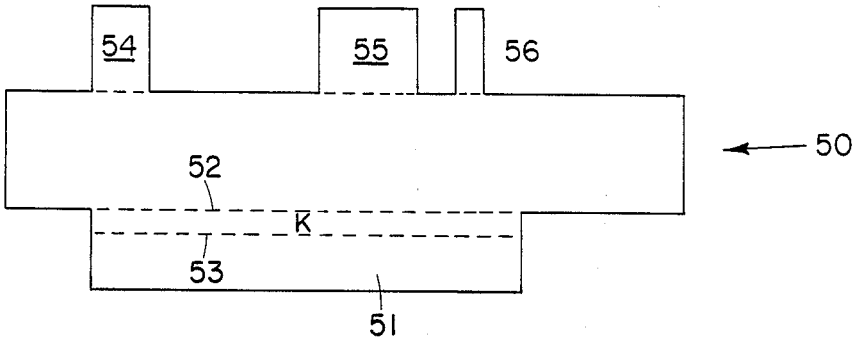

FIG. 4 is a plan view of the middle piece of the invention.

Figure 4A:
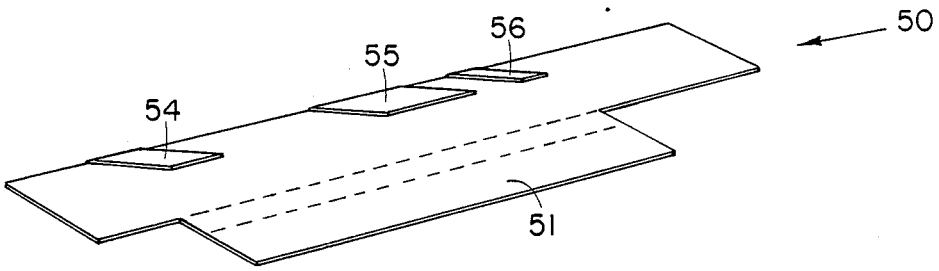
Figure 4B:
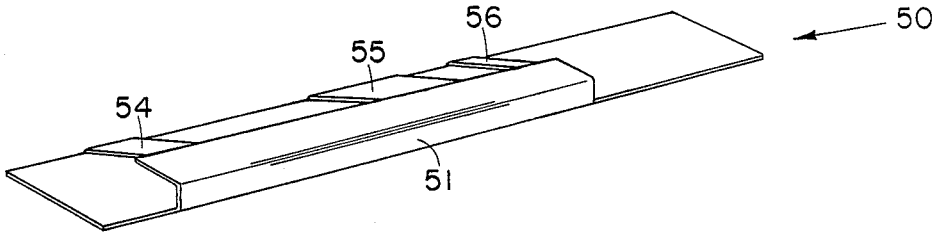

FIGS. 4A and 4B are a series of perspective views, showing the middle piece as folded for packaging a door unit.

IV. DETAILED DESCRIPTION OF THE INVENTION

Figure 1:
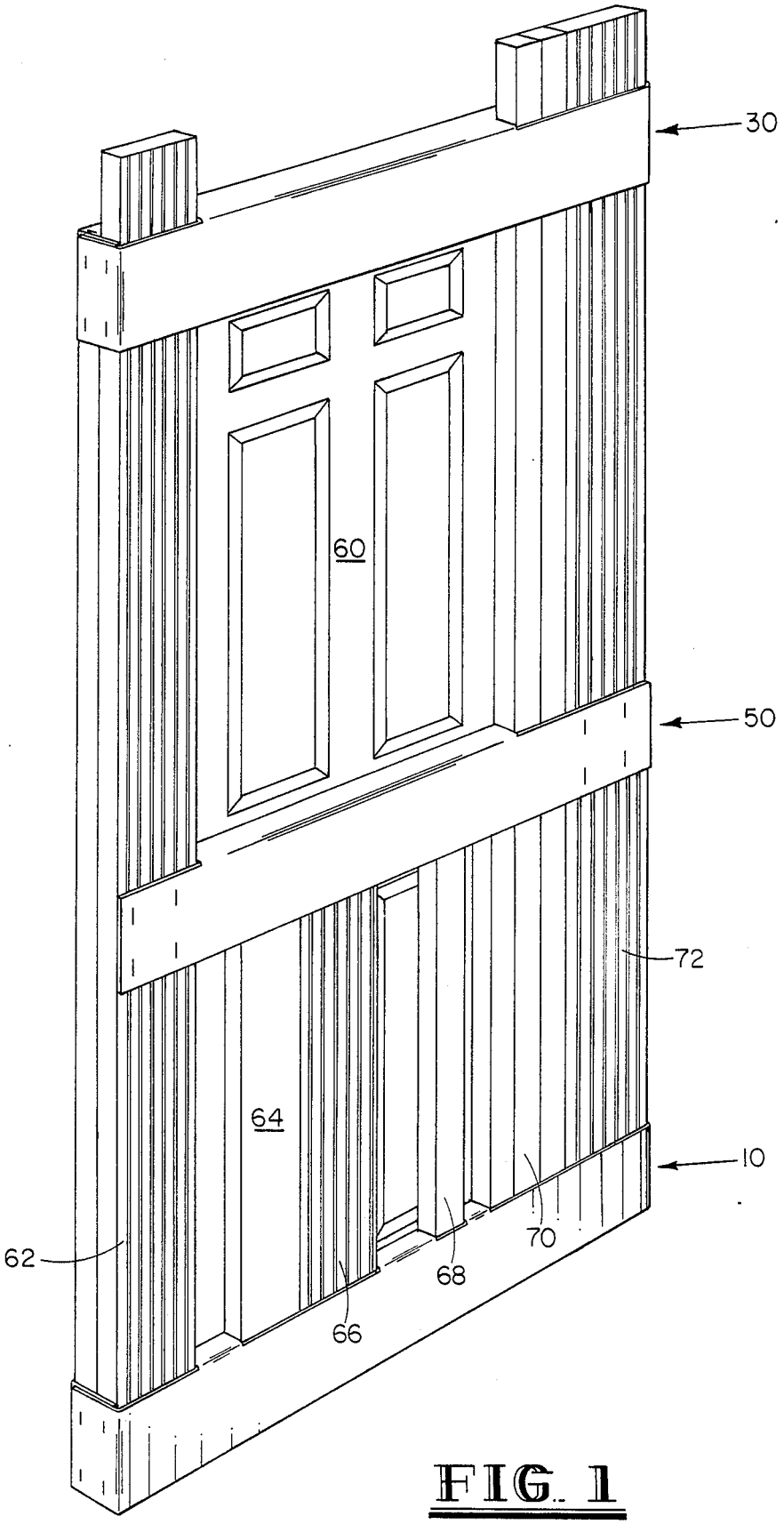
FIG. 1 is a perspective view showing the door unit packaging as used to package a door unit.

FIG. 1 shows packaged door unit installation kit. The packaging has three pieces: the bottom piece 10, top piece 30, and middle piece 50. Various parts of the door unit are contained within the packaging. In FIG. 1 the parts shown are: a door 60, hinge jamb 62, sill 64, head jamb 66, sweep 68, brick mold 70, and strike jamb 72. Brick mold 70 is composed of a top piece and two side pieces. Hardware (not shown) may be placed in the enclosed area formed by bottom piece 10. The packaging is easily adapted to fit additional or other parts as may be desired.

In the preferred embodiment, the packaging is made from a cardboard blank. Other foldable material can be used.

FIG. 2 shows the bottom piece 10, the dotted lines representing creases in the cardboard. These creases facilitate folding when the packaging is placed around the door unit.

Two parallel creases 11 and 12 extend across bottom piece 10. The distance A between creases 11 and 12 is approximately the same as the combined thickness of the door and the thickest of hinge jamb 62, head jamb 66, or strike jamb 72.

Flaps 16 and 17 are made at each end of bottom piece 10 by means of creases 13 and 14. The width of each flap 16 and 17 is the distance B between the end of bottom piece 10 and crease 13 or 14. Distance B is approximately the same as distance A.

Bottom piece end tabs 18 and 19 are made at each end of bottom piece 10 by cutting two parallel slits into the cardboard blank. The width of end tabs 18 and 19 is approximately the same as width A between creases 11 and 12. The height of end tabs 18 and 19 is the approximately the same as distance B.

Bottom spacer 20 extends from the front side of bottom piece 10. Bottom spacer 20 has cut out portions 21 and 22. Cut out 21 is of slightly larger dimension than the combined widths of sill 64 and head jamb 66, while cut out 22 is of slightly larger dimension than the width of sweep 68. Creases 23 and 24 in bottom spacer 20 facilitate folding. Distance C between spacer 20 and crease 13 is approximately the same as the width of hinge jamb 62. Distance D between spacer 20 and crease 14 is approximately the same as the combined width of strike jamb 72 and brick mold 70 when placed side by side.

FIGS. 2A, 2B, and 2C show the steps of folding bottom piece 10 so that the door unit kit may be contained therein. At each end of bottom piece 10, tabs 18 and 19 are folded up along creases 13 and 14, respectively. Bottom spacer 20 is folded along creases 23 and 24. Bottom spacer 20 then consists of a cushion pad **20*a* and a holder bar 20*b*. The front and back sides of bottom piece 10 are folded up along creases 11 and 12, respectively. Flaps 16 and 17 are folded in against and attached to end tabs 18 and 19**, respectively, to form a topless box. Typically, this attachment is with staples or glue.

As shown in FIG. 1, the door unit parts fit snugly into the box formed by bottom piece 10. Cushion pad **20*a* of bottom spacer 20 provides a cushion surface between door 60 and the other parts of the door unit. At the same time, cut out portions 21 and 22 in the holder bar 20*b* hold sill 64, head jamb 66, and sweep 68 in place. Hinge jamb 62 fits snugly into space provided by distance C. Strike jamb 72 and brick mold 70 are placed side by side and fit snugly into the space provided by distance D. Bottom piece 10 is attached to door unit by means of staples. If desired, the attachment of flaps 16 and 17 to end tabs 18 and 19, and the attachment of bottom piece 10** to the door unit, may be by the same means, such as with a staple gun.

The width of bottom piece 10 is approximately the same as the width of door 60 plus two times distance B. The length of bottom piece 10 is sufficient to provide vertical support for the door unit kit when placed inside the box formed by bottom piece 10 when folded, as shown in FIGS. 1, 2A, 2B, and 2C.

FIG. 3 shows the top piece 30, the dotted lines representing creases in the cardboard. These creases facilitate folding when the packaging is placed around the door unit.

Two parallel creases 31 and 32 extend across top piece 30. The distance G between creases 31 and 32 is approximately the same as the combined thickness of the door and the thickest of hinge jamb 62, or strike jamb 72.

Cut out portions 33 and 34 allow taller parts such as the hinge jamb 62 and strike jamb 72 to extend through the top piece 30 at the point where they are taller than door 60. This secures hinge jamb 62 and strike jamb 72 and prevents them from moving within the packaging container. The size of cutout portions 33 and 34 may be modified to accommodate additional tall door unit parts, such as weatherstripping.

Flaps 35 and 36 are made at each end of top piece 30 by means of creases 37 and 38. The width of each flap 35 and 36 is the distance H between the end of top piece 30 and crease 31 or 32. Distance H is approximately the same as distance G.

Top piece end tabs 38 and 39 are made at each end of top piece 30 by cutting two parallel slits into the cardboard blank. The width of end tabs 38 and 39 is approximately the same as the width G between creases 31 and 32. The height of tabs 38 and 39 is approximately the same as distance D.

Top spacer 40 extends from the front side of top piece 30. Creases 41 and 42 in top spacer 40 facilitate folding. Distance I between top spacer 40 and crease 37 is approximately the same as the width of hinge jamb 62. Distance J between top spacer 40 and crease 38 is approximately the same as the combined widths of brick mold 70 and strike jamb 72.

FIGS. 3A, 3B, and 3C show the steps of folding top piece 30 so that the door unit kit may be contained therein. At each end of top piece 30, tabs 38 and 39 are folded up along creases 37 and 38, respectively. Top spacer 40 is folded along creases 41 and 42. Top spacer 40 then consists of a top cushion pad **40*a* and a top holder bar 40*b*. The front and back sides of top piece 30 are folded up along creases 31 and 32. Flaps 35 and 36 are folded in against and attached to end tabs 38 and 39**, respectively, to form a topless box. Typically, this attachment is with staples or glue.

As shown in FIG. 1, the door unit parts fit snugly into the box formed by top piece 30. The strike jamb 72 and hinge jamb 62 extend through cut out portions 33 and 34 respectively. This permits top piece 30 to rest on the top of door 60 so that door 60 is held firmly in place. Strike jamb 72 fits snugly in the space provided by distance I. Hinge jamb 62 fits snugly in the space provided by distance J. Top piece 30 is attached to the door unit jambs by means of staples. If desired, the attachment of flaps 35 and 36 to end tabs 38 and 39, and the attachment of top piece 30 to the door unit, may be by the same means, such as with a staple gun.

The width of top piece 30 is approximately the same as the width of door 60 plus two times distance B. The length of top piece 30 is sufficient to securely hold the door 60 when placed inside the box formed by bottom piece 30 when folded, as shown in FIGS. 1, 3A, 3B, and 3C.

FIG. 4 shows the middle piece 50, the dotted lines representing creases in the cardboard blank. These creases facilitate folding when the packaging is placed around the door unit.

Middle spacer 51 extends from the top side of middle piece 50. Creases 52 and 53 in middle spacer 51 facilitate folding. The distance K between creases 52 and 53 is approximately the same as the thickness of sill 64, head jamb 66, and sweep 68.

Position tabs 54, 55 and 56 extend from the bottom side of middle piece 50. Each of these position tabs keeps a door unit part at its proper position within the container. Position tab 54 separates hinge jamb 62 from sill 64 and head jamb 66. Position tab 55 separates sill 64 and head jamb 66 from sweep 68. Position tab 56 separates sweep 66 from brick mold 70 and strike jamb 72. These separations prevent the various door unit parts from banging against each other. The hinge jamb 62, sill 64, head jamb 66, sweep 68 brick mold 70, and strike jamb 72 each fit securely inside the spaces between the position tabs 54, 55, and 56. These door unit parts are thus held in place inside middle spacer 51.

FIGS. 4A and 4B show the steps of folding middle piece 50 so that the door unit kit may be contained therein. Middle spacer 51 is folded so that it forms a protective cushion between door 60 and the top of sill 64, head jamb 66, and sweep 68. Position tabs 54, 55, and 56 are folded so that they hold sill 64, head jamb 66, and sweep 68 in place.

The width of middle spacer 51 is approximately the same as the width of door 60. The length of middle spacer 50 is sufficient to hold sill 64, head jamb 66, and sweep 68 against door 60 when the door unit kit is placed inside the container when folded, as shown in FIGS. 1, 4A and 4B.

The method of assembling the door unit installation kit is as follows. Various door units parts are collected for inclusion in the kit, such as a door 60, hinge jamb 62, sill 64, head jamb 66, sweep 68, brick mold 70, and strike jamb 72.

A bottom piece 10 for the container is folded as shown in FIGS. 2A, 2B, and 2C. The flaps 16 and 17 are fastened to end tabs 18 and 19, respectively. Typical fastening means include staples or glue. The door 60, hinge jamb 62, sill 64, head jamb 66, sweep 68, brick mold 70, and strike jamb 72 are placed in their appropriate positions inside the box formed by folding bottom piece 10, as shown in FIG. 1. Hardware may also be placed in the enclosed space formed inside bottom piece 10. Bottom piece 10 is then attached to the jambs 62 and 72 with staples.

A top piece 30 for the container is folded as shown in FIGS. 3A, 3B, and 3C. The end tabs 38 and 39 are fastened to the flaps 35 and 36 respectively. Typical fastening means include staples or glue. The top piece 30 is slid into place against the top of door 60. The ends of hinge jamb 62, side pieces of brick mold 70 and strike jamb 72 extend through cut out portions 33 and 34, respectively. Top piece 30 is attached to the jambs 62 and 72 with staples.

The middle piece 50 for the container is folded as shown in FIGS. 4A and 4B. It is placed across the front of the door unit installation kit, with the spacer 51 being placed over the top of sill 64, head jamb 66, top piece of brick mold 70 and sweep 68. The ends of middle piece 50 are fastened to the hinge jamb 62 and strike jamb 72 respectively. A typical fastening means is staples.

A variation of the method of assembling the door unit permits the door unit parts to be placed on the flat top piece and flat bottom piece. The container is then folded around the door, rather than being folded first with the door subsequently placed inside. This method is particularly convenient because the steps of fastening the top piece and the bottom piece into a box shape and the step of fastening the container pieces to the door unit may be combined.

Ideally, if fastening means such as staples or tacks is used, the stapling or tacking is done to the jambs or other surfaces of the door unit that will not show after the door is installed.

Although the invention has been described with reference to specific embodiments, this description is not meant to be construed in a limiting sense. Various modifications of the disclosed embodiment, as well as alternative embodiments of the invention will become apparent to persons skilled in the art upon reference to the description of the invention. It is therefore contemplated that the appended claims will cover such modifications that fall within the true scope of the invention.

I claim:

1. A container for a packaged door unit that includes a standard size door and jambs, which are at least as tall as said door, comprising:

a bottom piece, made of foldable sheet material, said bottom piece being of sufficient dimensions so that it may be folded up to envelop a bottom end of said door, said bottom piece having a front edge, back edge, and two side edges wherein said side edges each have a precut tab, said bottom piece having a bottom spacer flap extending from said front edge, said bottom spacer flap being foldable to form an L-shaped spacer that may be inserted between said door and said bottom piece, said spacer having cut-out portions that are of sufficient size to allow said door jambs to be inserted therein in an upright position;

a top piece, made of foldable sheet material, said top piece being of sufficient dimensions so that it may be folded to envelop a top end of said door, said top piece having a front edge, back edge, and two side edges, wherein said side edges each have a precut tab.

2. The container of claim 1 wherein said bottom piece and said top piece each have two parallel creases to facilitate folding, said creases extending across said top and said bottom piece, and the space between said parallel creases being approximately the thickness of the door unit.

3. The container of claim 1 wherein said top piece has cut out portions to allow said door jambs to extend through said top piece when the top piece is in place around said door unit.

4. The container of claim 3 wherein said top piece has a top spacer flap extending from said front side, said top spacer flap being foldable to form an L-shaped spacer that may be inserted between said door and said top piece.

5. A container for a packaged door unit that includes a door and jambs, which are at least as tall as said door, and one or more shorter door unit parts, which are approximately half as high as said door, comprising:

a bottom piece, made of foldable sheet material such as cardboard, said bottom piece being of sufficient dimensions so that it may be folded up to envelop a bottom end of said door, said bottom piece having a front edge, back edge, and two side edges wherein said side edges each have a precut tab, said bottom piece having a bottom spacer flap extending from said front edge, said bottom spacer flap being foldable to form an L-spacer that may be inserted between said door and said bottom piece, said spacer having cut-out portions that are of sufficient size to allow said door jambs to be inserted therein in an upright position;

a top piece, made of foldable sheet material such as cardboard, said top piece being of sufficient dimensions so that it may be folded to envelop a top end of said door, said bottom piece having a front edge, back edge, and two side edges, wherein said side edges each have a precut tab;

a middle piece, made of foldable sheet material such as cardboard, said middle piece being of sufficient width to allow said middle piece being of sufficient width to allow said middle piece to extend across the door unit to be packaged, said middle piece having a front and back side and having position tabs extending from one side at convenient locations to secure said door unit parts.

6. The container of claim 5 wherein said middle piece has a middle spacer flap extending from said front side, said middle spacer flap being foldable to form an L-shaped spacer that may be inserted between said door and the top of said door unit part.

* * * * *